United States Patent [19]

Bedgood

[11] Patent Number: 4,565,369

[45] Date of Patent: Jan. 21, 1986

[54] AQUATIC EXERCISING DEVICE

[76] Inventor: Douglas H. Bedgood, P.O. Box 1820, Idyllwild, Calif. 92349

[21] Appl. No.: 481,207

[22] Filed: Apr. 1, 1983

[51] Int. Cl.[4] ..... A63B 21/00

[52] U.S. Cl. ..... 272/130; 272/143; 272/116

[58] Field of Search ..... 272/130, 71, 93, 72, 272/116, 96, 143; 128/25 R; 46/91; 446/153

[56] References Cited

U.S. PATENT DOCUMENTS

| | | | |
|---|---|---|---|
| 373,692 | 11/1887 | Shaaber | 272/71 UX |
| 4,411,422 | 10/1983 | Solloway | 272/96 |
| 4,416,451 | 11/1983 | Solloway | 272/116 |

FOREIGN PATENT DOCUMENTS

| | | | |
|---|---|---|---|
| 602230 | 5/1948 | United Kingdom | 272/71 |

*Primary Examiner*—Richard J. Apley
*Assistant Examiner*—William R. Browne
*Attorney, Agent, or Firm*—Neuman, Williams, Anderson & Olson

[57] ABSTRACT

A variable resistance aquatic exercising device is provided for subjecting arms, legs and associated parts of a user's body to desired degrees of stress as the user moves his arms or legs through a body of water. The exercising device has a handle and a plurality of flat, elongate panels disposed in stacked relation to each other. Each panel has a mounting aperture through its center. A bolt extends through the apertures and adjustably attaches the panels to the handle. Spacers are positioned between adjacent panels to permit fluid flow between the panels and to protect the surfaces of the panels. The exercising device also has a flexible and adjustable mounting strap, disposed opposite the handle and attached to the panels.

12 Claims, 5 Drawing Figures

AQUATIC EXERCISING DEVICE

BACKGROUND OF THE INVENTION

1. Field of the Invention

The present invention relates to a physical exercising apparatus, and more particularly to a variable resistance aquatic exercising device for therapeutic exercising of an individual's arms and legs and associated muscle systems.

2. Description of the Prior Art

In the past, various exercises have been devised and used to condition the body. Most of these exercises condition and strengthen the muscles of the arms, legs and associated parts of the body by subjecting the arms and legs to resistance as they move from one position to another. The degree of strengthening and conditioning produced by these exercises is related to the magnitude of the resistance and the duration of the exercising. One such exercise involves the lifting or moving of weights as individual units or in association with mechanical devices. To increase the magnitude of the resistance in this exercise one must increase the size of the weights; but using heavier weights increases the risk of injury. An individual performing the exercise with heavy weights may drop them and injure himself; he may encounter problems in balancing the weights or keepng his balance and injure himself; or he may find it difficult to abort the exercise if his strength fails him in the middle of a movement.

Another exercise involves performing various movements in a body of water and using the resistance provided by the water to strengthen and condition the arms, legs and associated parts of the body. There are a number of advantages in using this form of exercise. First, the individual performing the exercise does not have to use weights, springs or other mechanical devices that increase the risk of injury. Second, the stabilizing effect of the water helps him keep his balance. Finally, he can abort the exercise during a movement without risk of injury.

Exercise devices designed to take advantage of water resistance in a body of water are known; but they suffer a host of disadvantages or disabilities. Most of these devices require that the user only wear them on either his feet or his hands. This restriction prevents the user of the device from performing certain movements and exercise routines which would strengthen and condition muscles affected by such movements or routines. Some devices provide mechanisms to vary the resistance to movement through the water; but they use complicated valve arrangements for this purpose, mechanisms that increase and distribute the resistance unevenly, or mechanisms that vary the resistance only slightly because they do not significantly vary the effective surface area of the device. The exercise device of the present invention avoids these problems. It is a simple device that one can attach to any part of an arm or a leg, hand or foot. The user can adjust the exerciser to vary the resistance to water easily and distribute it evenly.

OBJECTS OF THE INVENTION

It is a general object of this invention to provide an improved variable resistance aquatic exercising device.

Accordingly, it is an object of the present invention to provide an improved, low cost, and simplified aquatic exercise device for strengthening and conditioning the arms, legs and associated parts of the body.

It is another object of the invention to provide an aquatic exercise device which is free of weights and springs and which utlizes water resistance and allows quick and easy adjustment by the user of the effective surface area of the device, increasing or decreasing the water resistance.

It is yet another object of this invention to provide an aquatic exercise device which the user may strap to any part of his arms or legs, allowing him to perform a variety of movements and to condition most of the muscles in his arms, legs and associated parts and muscle systems of his body.

Other objects, advantages and features of the present invention will become apparent upon reading the following detailed description and appended claims, and upon reference to the accompanying drawing.

SUMMARY OF THE INVENTION

In accordance with one embodiment of this invention, the foregoing objects are achieved by an aquatic exercise device which includes a handle having a flat base with a mounting aperture; a plurality of flat, elongate panels, each having a mounting aperture; an axle means passing through the apertures in the panels and the base of the handle and attaching the panels to the handle; and a padded hook and loop-type strap disposed opposite the handle and attached between the panel located the farthest from the handle and the panel next to it. The panels are adapted for rotational movement around the axle means which passes through their mounting apertures, allowing the user of the device to arrange the panels in various configurations, including a full disk. The axle means has a thin, flat head at the end of the device opposite the handle and, at the handle, an adjusting nut used to lock the panels in place after they have been arranged in the desired configuration.

BRIEF DESCRIPTION OF THE DRAWINGS

For a more complete understanding of this invention reference should now be made to the embodiment illustrated in greater detail in the accompanying drawing and described below by way of an example of the invention. In the drawing.

While the invention will be described in connection with a preferred embodiment, it will be understood that it is not limited to this embodiment.

DETAILED DESCRIPTION OF THE DRAWINGS AND A PREFERRED EMBODIMENT

Figure 1:
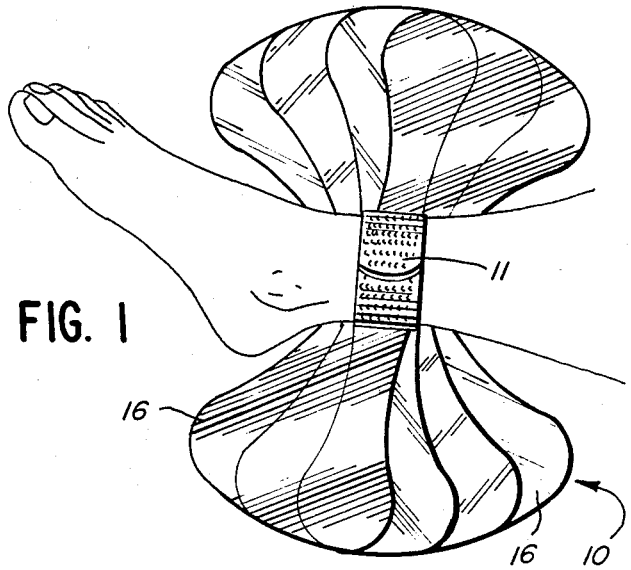
FIG. 1 is a perspective view of a preferred embodiment of the exercise device indicating the manner in which a user may mount it on his leg.

Turning now to the drawing and principally FIG. 1, the preferred embodiment of a variable resistance aquatic exercising device according to the invention is shown generally at 10. The exercise device is illustrated as mounted on a user's leg using a hook and loop-type strap 11 and made up of a plurality of identical, symmetrical panels 16.

Figure 2A:
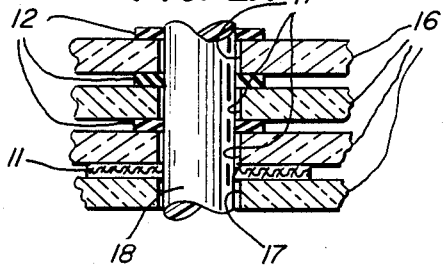
FIG. 2A is an exploded and partially cut away view of the device as shown in FIG. 2.
Figure 2:
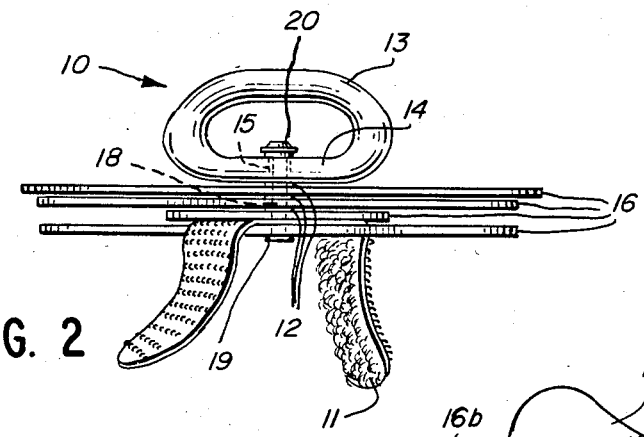
FIG. 2 is a side elevational view of the exercise device.

Referring now to FIGS. 2 and 2A, the components of one preferred exercise device 10 are shown. They include a handle 13 having a flat base 14 with a central aperture 15, a plurality of flat elongate panels 16 each having a central aperture 17, a bolt 18 with a flat head 19 and with an adjusting nut 20, and a hook and loop-type strap 11. Thin washers or spacers 12 permit easier adjustment of the panels, prevent damage to the panels during adjustment, and can also provide some additional control over the fluid resistance. The spacers are preferably made of polytetrafluoroethylene or other tough material with some lubricity. Strap 11 is disposed opposite handle 13 between the panel located the farthest from handle 13 and the panel next to it. Strap 11 is a padded hook and loop-type strap of sufficient length to wrap around a user's arms, feet, calves or thighs.

The aquatic exercising device 10 is assembled by bolt 18 which passes through apertures 17 in panels 16, through spacers 12, through a central aperture (not shown) in strap 11, and through central aperture 15 of handle base 14, attaching panels 16 and strap 11 to handle 13. The adjusting nut 20 is threaded onto the correspondingly threaded end of bolt 18.

Handle 13 is a unitary generally U-shaped, rounded member with a flat base 14; and it is preferably made from a stiff plastic material or lacquered wood. It is sized to allow a user to safely wrap has hand around it and grip it.

Figure 3:
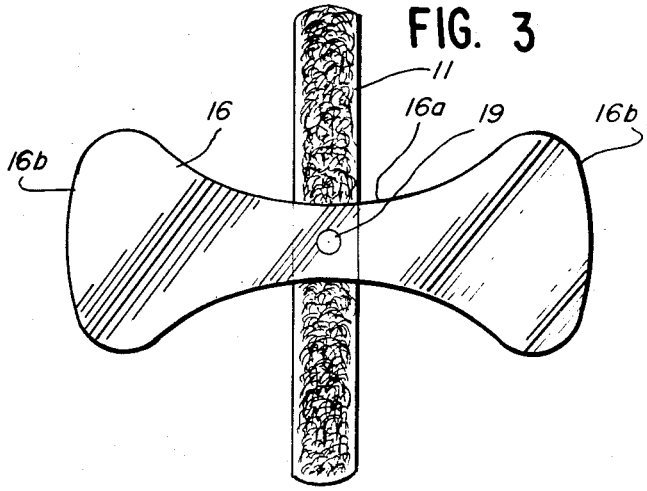
FIG. 3 is a bottom plan view of the exercise device in a closed configuration.

Each panel 16 is a flat plate of the shape shown in FIG. 3 made from a stiff plastic material, either clear translucent or opaque, or from lacquered wood. The panels may be double bladed with a narrow middle section **16*a* and rounded end section 16*b*. They could also be single bladed, but such a construction is dynamically less effective. Each panel is adapted for rotational movement around bolt 18 which passes through its central aperture 17. The panels are arranged in a stack, one on top of the other, as shown in FIG. 2. Placed in an open configuration, the panels 16 form a disk (see FIG. 4**).

Figure 4:
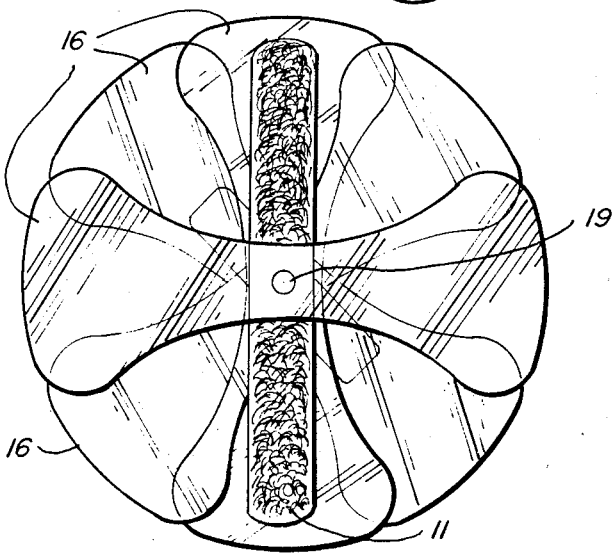
FIG. 4 is a bottom plan view of the exercise device in a fully opened or disk configuration.

The bolt 18 and adjusting nut 20 are made of metal or hard plastic, and they adjustably attach panels 16 to handle 13, allowing the user to place the panels in the desired configuration, such as the fully closed configuration of FIG. 3, the fully open configuration of FIG. 4 or any configuration between these two. The configuration is preferably always symmetrical.

To use the device, one first loosens adjusting nut 20 of bolt 18. He then arranges panels 16 in the desired configuration rotating each panel 16 around bolt 18 to a predetermined location. After he does this, he tightens nut 20 to lock panels 16 in place. Finally, using strap 11, the user attaches the exercise device 10 to the desired section of any limb of his body.

By changing the configuration of the panels 16, the user can vary the resistance provided by the device. Another method of varying the resistance is by substituting longer or different shaped panels for the device. For example, the panels could be shaped to produce openings between panels spaced inwardly from the disc periphery. The panels could also be perforated. Resistance could also be varied by using different spacer thicknesses for spacers 12.

Thus, a variable resistance aquatic exercise device is provided that is of simple yet effective construction, inexpensive to manufacture, and easy to adjust; yet it is capable of effectively providing controlled and adjustable resistance during therapeutic or other exercising in a body of water. While only one embodiment of the invention has been shown, it will be understood, of course that the invention is not limited thereto since modification may be made and other embodiments of the principles of this invention will occur to those skilled in the art to which the invention pertains, particularly upon considering the foregoing teachings. The following are examples of such modifications. First, aperture 15 of handle base 14 may be threaded, and handle 13 may be used to perform the function of adjusting nut 20. Second, the number, size and shape of panels 16 may be varied. Third, the handle may be fixedly attached to a panel 16, and the remaining panels adjustably attached to this panel. Finally, a locking mechanism may be provided in each panel to lock it in place after adjustment. One such locking mechanism may consist of projections on one panel lockingly engaging grooves in the adjacent panel if no spacers are used. In the alternative, the spacers 12 may be in the nature of serrated lock washers.

It is, therefore, contemplated by the appended claims to cover any such modifications and other embodiments as incorporate these features which constitute the essential features of this invention within the true spirit and scope of the following claims.

What is claimed is:

1. A variable resistance aquatic-exercising device for subjecting arms, legs and associated parts of a user's body to desired degrees of stress as the user moves his or her arms or legs through a body of water with the device associated therewith, said variable resistance aquatic exercising device comprising: a plurality of panel means for use in a body of water and for providing an area of contact for water to resist the movement of said device and the leg or arm associated with it, said plurality of panel means disposed in a stacked, generally fan shaped configuration with each of said plurality of panel means overlapping a portion of the adjacent panel means; attaching means for securing each of said panel means together and for adjusting the proportion of overlap of each of said panel means relative to an adjacent one of said panel means to vary the total surface area of said panel means by reducing or increasing the total area of contact of said plurality of panel means with water; and securing means attached to at least one of said panel means for securing said device to the arms or legs of a user.

2. The device of claim 1 wherein each of said panel means is of molded one-piece construction having rounded distal ends and narrow middle sections.

3. The device of claim 1 wherein said attaching means is a bolt with a flat head at one end and an adjusting nut at the other end.

4. The device of claim 3, wherein said panels each having a central aperture through which said bolt extends, said panels being pivotally adjustable relative to one another around said bolt to vary the total surface area formed by said panels.

5. The device of claim 1 wherein said plurality of panel means open into a disk configuration.

6. The device of claim 1, wherein said securing means is a handle and a strap.

7. A variable resistance aquatic exercising device for subjecting arms, legs and associated parts of a user's body to desired degrees of stress as the user moves his or her arms or legs through a body of water with the device associated therewith, said variable resistance aquatic exercising device comprising a handle having a flat base with an aperture in said base; a plurality of flat, elongate panels disposed in a stacked, generally fan shaped configuration with each of said plurality of panels overlapping a portion of the adjacent panel, each of said panels being symmetrical about a central aperture; a bolt passing through said apertures in said panels and said base of said handle and adjustably securing each of said panels to said handle, said panels being pivotally adjustable relative to one another around said bolt to vary the total surface area formed by said panels; and a body attaching strap attached to at least one of said panels for permitting the user to use said device.

8. The device of claim 7 wherein said strap has a central opening.

9. The device of claim 7 wherein said strap is a hook and loop-type strap.

10. The device of claim 7 including apertured spacers wherein said panels are spaced apart by said spacers.

11. The device of claim 7 wherein said panels are spaced apart and locked into the desired configuration with serrated lock washers.

12. A variable resistance aquatic exercising device for subjecting arms, legs and associated parts of a user's body to desired degrees of stress as the user moves his or her arms or legs through a body of water with the device associated therewith, said variable resistance aquatic exercising device comprising a handle having a flat base with an aperture in said base; a plurality of flat, elongate panels disposed adjacent said handle in a stacked, generally fan shaped configuration with each of said plurality of panels overlapping a portion of the adjacent panel, each of said panels being symmetrical about a central aperture; a body attaching strap having a central aperture and disposed between the two distal panels opposite said handle, said handle permitting the user to grasp and use said device; and a bolt passing through said apertures in said panels, said base of said handle, and said strap and adjustably securing each of said panels and said strap to said handle, said panels being pivotally adjustable relative to one another around said bolt to vary the total surface area formed by said panels.

* * * * *